US006588245B2

(12) United States Patent
O'Fathaigh

(10) Patent No.: US 6,588,245 B2
(45) Date of Patent: Jul. 8, 2003

(54) ROLL GAP CONTROL FOR COILER

(75) Inventor: Barra O'Fathaigh, Roanoke, VA (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/929,494

(22) Filed: Aug. 15, 2001

(65) Prior Publication Data

US 2003/0033844 A1 Feb. 20, 2003

(51) Int. Cl.[7] ..... B21D 9/05

(52) U.S. Cl. ..... 72/150; 72/10.7; 72/14.1; 72/14.7; 72/148; 242/534

(58) Field of Search ..... 72/10.1, 10.7, 72/12.1, 13.4, 14.1, 14.7, 146, 148, 149, 150, 173, 174, 175; 242/534, 535, 535.1, 541, 541.4, 541.5, 547

(56) References Cited

U.S. PATENT DOCUMENTS

| | | | | | |
|---|---|---|---|---|---|
| 4,380,164 | A | * | 4/1983 | Kuwano | 72/148 |
| 4,736,605 | A | * | 4/1988 | Klockner et al. | 72/148 |
| 5,361,618 | A | * | 11/1994 | Stefanelli | 72/174 |
| 5,584,336 | A | | 12/1996 | Romanowski et al. | |
| 5,785,271 | A | * | 7/1998 | Leskinen et al. | 242/530.1 |
| 6,039,283 | A | * | 3/2000 | Munoz-Baca et al. | 242/534 |
| 6,227,021 | B1 | | 5/2001 | Imanari | |

* cited by examiner

*Primary Examiner*—Ed Tolan
(74) *Attorney, Agent, or Firm*—Karl Vick; Kevin Duncan; Hunton & Williams

(57) ABSTRACT

Roll gap control is provided using a first roll position detector that detects a first position of a first roll, a second roll position detector that detects a first position of a second roll and a third roll position detector that detects a first position of the third roll. A processor determines a second position of the first roll based on the first position of the second roll and the first position of the third roll.

29 Claims, 8 Drawing Sheets

Regulator mode supervisor.
This task supervises the regulator mode of operation.

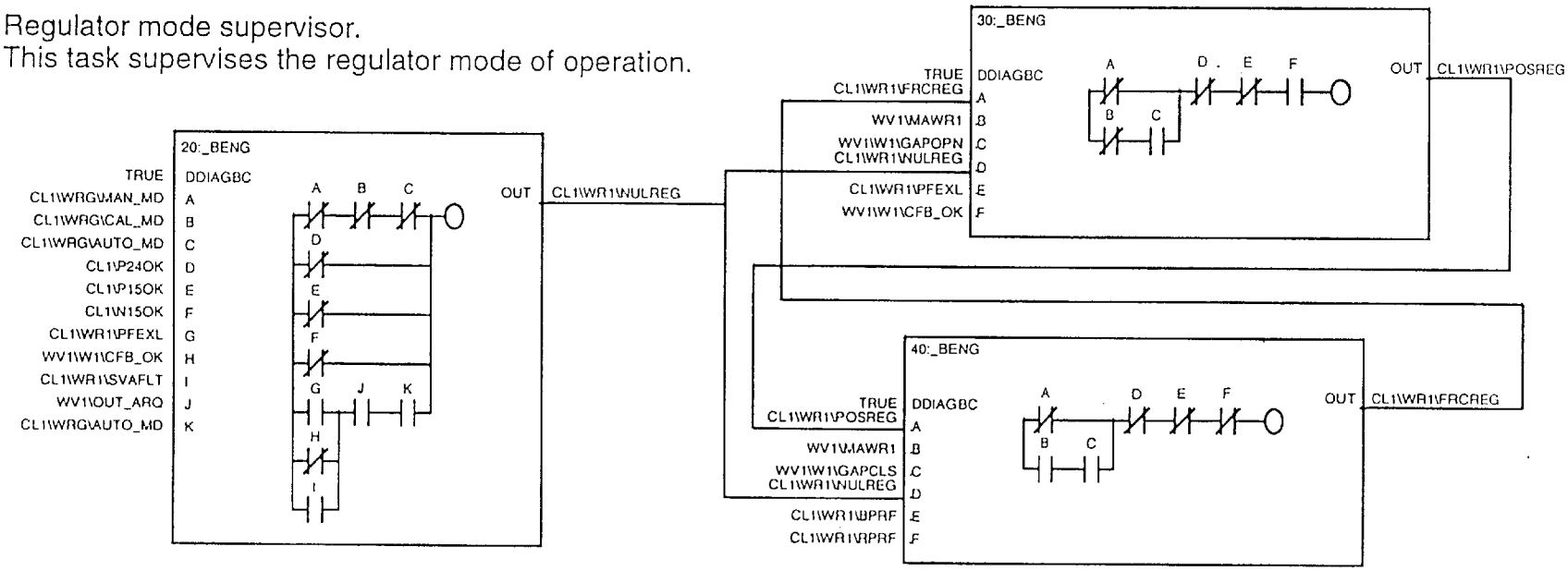

Signal Definitions

| | | | |
|---|---|---|---|
| N15OK (CL1\N15OK) | Bool | 0 | N15 VDC POWER SUPPLY OK. |
| P15OK (CL1\P15OK) | Bool | 0 | P15 VDC POWER SUPPLY OK. |
| P24OK (CL1\P24OK) | Bool | 0 | P24 VDC POWER SUPPLY OK. |
| BPRF (CL1\WR1\BPRF) | Bool | 0 | BLIND END PRES TRANS FAILURE. |
| FRCREG (CL1\WR1\FRCREG) | Bool | 0 | FORCE REGULATION MODE. |
| NULREG (CL1\WR1\NULREG) | Bool | 0 | NULL REGULATION MODE(REGULATOR OFF). |
| PFEXL (CL1\WR1\PFEXL) | Bool | 0 | POS FB EXTREME LIMIT. |
| POSREG (CL1\WR1\POSREG) | Bool | 0 | POSITION REGULATION MODE. |
| RPRF (CL1\WR1\RPRF) | Bool | 0 | ROD END PRES TRANS FAILURE. |
| SVAFLT (CL1\WR1\SVAFLT) | Bool | 0 | SERVO VALVE 'A' FAULT. |
| AUTO MD (CL1\WRG\AUTO MD) | Bool | 0 | AUTO MODE. |
| CAL MD (CL1\WRG\CAL MD) | Bool | 0 | CALIBRATION MODE. |
| MAN MD (CL1\WRG\MAN MD) | Bool | 0 | MANUAL MODE. |
| MAWR1 (WV1\MAWR1) | Bool | 0 | METAL AT WRAPPER ROLL #1. |
| OUT ARQ (WV1\OUT ARQ) | Bool | 0 | OUT AUTO REQUEST. |
| CFB OK (WV1\W1\CFB OK) | Bool | 0 | CYLINDER FEEDBACK OK. |
| GAPCLS (WV1\W1\GAPCLS) | Bool | 0 | GAP CLOSE COMMAND. |
| GAPOPN (WV1\W1\GAPOPN) | Bool | 0 | GAP OPEN COMMAND. |

Fig. 5

Null regulation.
This task provides the regulator open loop control or null regulation.

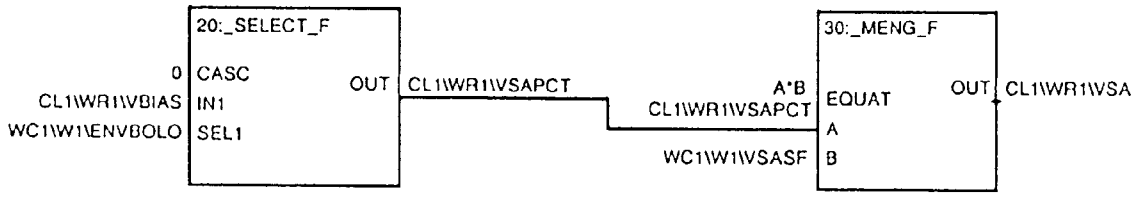

Signal Definitions

| | | | |
|---|---|---|---|
| VBIAS (CL1\WR1\VBIAS) | Float | 0 | VALVE BIAS (PCT). |
| VSA (CL1\WR1\VSA) | Float | 0 | WRAPPER ROLL #1 VALVE SIGNAL 'A' OUTPUT. |
| VSAPCT (CL1\WR1\VSAPCT) | Float | 0 | VALVE 'A' SIGNAL (PCT). |
| ENVBOLO (WC1\W1\ENVBOLO) | Bool | 0 | ENABLE VALVE BIAS OUTPUT WHEN CONTROL LOOP OPEN. |
| VSASF (WC1\W1\VSASF) | Float | -0.04 | VALVE 'A' SIGNAL SCALE FACTOR. |

Fig. 6

Signal Definitions

| | | | |
|---|---|---|---|
| ATNBLM (CL1\WR1\ATNBLM) | Bool | 0 | AT NULL BIAS LIMIT |
| BPRF (CL1\WR1\BPRF) | Bool | 0 | BLIND END PRES TRANS FAILURE. |
| GAPFB (CL1\WR1\GAPFB) | Float | 0 | GAP FEEDBACK (MM IN). |
| RPRF (CL1\WR1\RPRF) | Bool | 0 | ROD END PRES TRANS FAILURE. |
| VBIAS (CL1\WR1\VBIAS) | Float | 0 | VALVE BIAS (PCT). |
| VSA (CL1\WR1\VSA) | Float | 0 | WRAPPER ROLL #1 VALVE SIGNAL 'A' OUTPUT. |
| VSAPCT (CL1\WR1\VSAPCT) | Float | 0 | VALVE 'A' SIGNAL (PCT). |
| GAPFB (CL1\WR2\GAPFB) | Float | 0 | GAP FEEDBACK (MM IN). |
| GAPFB (CL1\WR3\GAPFB) | Float | 0 | GAP FEEDBACK (MM IN). |
| NBDLY (WC1\W1\NBDLY) | Float | 5 | NULL BIAS COMPENSATION START DELAY (SEC). |
| NBEN (WC1\W1\NBEN) | Bool | 1 | NULL BIAS COMPENSATION ENABLE. |
| NBGAIN (WC1\W1\NBGAIN) | Float | 0.1 | NULL BIAS INTEGRATION GAIN. |
| NBHILM (WC1\W1\NBHILM) | Float | 20 | NULL BIAS HIGH LIMIT (X100%). |
| NBLOLM (WC1\W1\NBLOLM) | Float | -20 | NULL BIAS LOW LIMIT (X100%). |
| PKCLS (WC1\W1\PKCLS) | Float | 0.66 | POSTION LOOP CLOSE GAIN. |
| PKOPN (WC1\W1\PKOPN) | Float | 0.74 | POSTION LOOP OPEN GAIN. |
| VSASF (WC1\W1\VSASF) | Float | -0.04 | VALVE 'A' SIGNAL SCALE FACTOR. |
| HEADTRK (WV1\HEADTRK) | Bool | 0 | HEAD TRACKING ENABLE. |
| ATREF (WV1\W1\ATREF) | Bool | 0 | AT REFERENCE. |
| CURREF (WV1\W1\CURREF) | LFloat | 0 | CURRENT REFERENCE(STATE VARIABLE) (MM\|IN OR MTONS. |
| ERR (WV1\W1\ERR) | Float | 0 | ERROR (MM IN OR MTONS TONS). |
| GAPCLSC (WV1\W1\GAPCLSC) | Bool | 0 | GAP CLOSE COMMAND. |
| GAPOPNC (WV1\W1\GAPOPNC) | Bool | 0 | GAP OPEN COMMAND. |
| GAPREF (WV1\W1\GAPREF) | Float | 0 | GAP REFERENCE (MM IN). |
| NBFRZ (WV1\W1\NBFRZ) | Bool | 0 | NULL BIAS FREEZE - LARGE MOVE IN PROGRESS. |
| PDECRR (WV1\W1\PDECRR) | Float | 0 | POS DECREASE REF RAMP RATE (MM IN/MIN). |
| PERRHIL (WV1\W1\PERRHIL) | Float | 0 | POS REG ERROR HI LIMIT (PCT). |
| PERRLOL (WV1\W1\PERRLOL) | Float | 0 | POS REG ERROR LO LIMIT (PCT). |
| PGAIN (WV1\W1\PGAIN) | Float | 0 | POSITION REG FORWARD LOOP-GAIN. |
| PINCRR (WV1\W1\PINCRR) | Float | 0 | POS INCREASE REF RAMP RATE (MM IN/MIN). |
| PRAMPB (WV1\W1\PRAMPB) | Bool | 0 | POSITION REGULATOR RAMP BYPASS. |
| PSROFF (WV1\W1\PSROFF) | Float | 0 | POSITION REGULATOR TUNE-UP OFFSET (in/mm). |
| TOTERR (WV1\W1\TOTERR) | Float | 0 | TOTAL ERROR SIGNAL (UNCLAMPED) (X100%). |
| TRMXC (WV1\W1\TRMXC) | Bool | 0 | TRAVERSE TO MAX GAP COMMAND. |
| VCOM (WV1\W1\VCOM) | Float | 0 | VALVE COMMAND (X100%). |
| VCSV1 (WV1\W1\VCSV1) | LInt | 0 | VALVE CONTROL STATE VAR #1 (NULL BIAS) |
| VCSV2 (WV1\W1\VCSV2) | LFloat | 0 | VALVE CONTROL STATE VAR #2 (NULL BIAS) |
| VCSV3 (WV1\W1\VCSV3) | Float | 0 | VALVE CONTROL STATE VAR #3 (NULL BIAS) |

Fig. 8

Force regulation.
This task provides the regulator force regulation.

Signal Definitions

| | | | |
|---|---|---|---|
| ATNBLM (CL1\WR1\ATNBLM) | Bool | 0 | AT NULL BIAS LIMIT. |
| FRCFB (CL1\WR1\FRCFB) | Float | 0 | FORCE FEEDBACK (MTONS TONS). |
| VBIAS (CL1\WR1\VBIAS) | Float | 0 | VALVE BIAS (PCT). |
| VSA (CL1\WR1\VSA) | Float | 0 | WRAPPER ROLL #1 VALVE SIGNAL 'A' OUTPUT. |
| VSAPCT (CL1\WR1\VSAPCT) | Float | 0 | VALVE 'A' SIGNAL (PCT). |
| FERRHIL (WC1\W1\FERRHIL) | Float | 100 | FRC REG ERROR HI LIMIT (PCT). |
| FERRLOL (WC1\W1\FERRLOL) | Float | -100 | FRC REG ERROR LO LIMIT (PCT). |
| FFBGAIN (WC1\W1\FFBGAIN) | Float | 1 | FORCE LOOP FEEDBACK GAIN. |
| FFFGAIN (WC1\W1\FFFGAIN) | Float | 1 | FORCE LOOP FEED-FORWARD GAIN. |
| FINGAIN (WC1\W1\FINGAIN) | Float | 0 | FORCE LOOP INTEGRATOR GAIN. |
| NBDLY (WC1\W1\NBDLY) | Float | 5 | NULL BIAS COMPENSATION START DELAY (SEC). |
| NBEN (WC1\W1\NBEN) | Bool | 1 | NULL BIAS COMPENSATION ENABLE. |
| NBGAIN (WC1\W1\NBGAIN) | Float | 0.1 | NULL BIAS INTEGRATION GAIN. |
| NBHILM (WC1\W1\NBHILM) | Float | 20 | NULL BIAS HIGH LIMIT (X100%). |
| NBLOLM (WC1\W1\NBLOLM) | Float | -20 | NULL BIAS LOW LIMIT (X100%). |
| VSASF (WC1\W1\VSASF) | Float | -0.04 | VALVE 'A' SIGNAL SCALE FACTOR. |
| ATREF (WV1\W1\ATREF) | Bool | 0 | AT REFERENCE. |
| CURREF (WV1\W1\CURREF) | LFloat | 0 | CURRENT REFERENCE(STATE VARIABLE) (MM\|IN OR MTONS. |
| ERR (WV1\W1\ERR) | Float | 0 | ERROR (MM IN OR MTONS TONS). |
| FDECRR (WV1\W1\FDECRR) | Float | 0 | FORCE DECREASE REF RAMP RATE (MTONS TONS/MIN). |
| FGAIN (WV1\W1\FGAIN) | Float | 0 | FORCE FORWARD LOOP GAIN. |
| FINCRR (WV1\W1\FINCRR) | Float | 0 | FORCE INCREASE REF RAMP RATE (MTONS TONS/MIN). |
| FKCLSGN (WV1\W1\FKCLSGN) | Float | 0 | FORCE REG FLOW RATE COMP CLOSE GAIN. |
| FKOPNGN (WV1\W1\FKOPNGN) | Float | 0 | FORCE REG FLOW RATE COMP OPEN GAIN. |
| FRCLO P (WV1\W1\FRCLO P) | Bool | 0 | FORCE REGULATOR LOCKON PULSE. |
| FRCREF (WV1\W1\FRCREF) | Float | 0 | CONTACT FORCE REFERENCE (MTONS TONS). |
| FSROFF (WV1\W1\FSROFF) | Float | 0 | FORCE REGULATOR TUNE-UP OFFSET (ton/mton). |
| GAPCLSC (WV1\W1\GAPCLSC) | Bool | 0 | GAP CLOSE COMMAND. |
| GAPOPNC (WV1\W1\GAPOPNC) | Bool | 0 | GAP OPEN COMMAND. |
| ICFR (WV1\W1\ICFR) | Float | 0 | INTERPOLATED CONTACT FORCE RATIO. |
| TOTERR (WV1\W1\TOTERR) | Float | 0 | TOTAL ERROR SIGNAL (UNCLAMPED) (X100%). |
| VCOM (WV1\W1\VCOM) | Float | 0 | VALVE COMMAND (X100%). |
| VCSV1 (WV1\W1\VCSV1) | LInt | 0 | VALVE CONTROL STATE VAR #1 (NULL BIAS) |
| VCSV2 (WV1\W1\VCSV2) | LFloat | 0 | VALVE CONTROL STATE VAR #2 (NULL BIAS) |
| VCSV3 (WV1\W1\VCSV3) | Float | 0 | VALVE CONTROL STATE VAR #3 (NULL BIAS) |

Fig. 10

ROLL GAP CONTROL FOR COILER

BACKGROUND OF THE INVENTION

Embodiments of the invention relate to gap control. More particularly, embodiments of the invention relate to gap control for a coiler.

Hot strip mill coilers are used for coiling strips of material such as, for example, steel into rolls to facilitate transport of the strip material to other locations for further processing. As the strip material is often metal or some other heavy material, and because the resulting rolls of strip material are often very large and heavy, proper control of the strip material during the coiling process is very important.

One method of controlling the strip material during coiling is to use a plurality of wrapper rolls (also known as blocker rolls or unit rolls) to press the strip material against a mandrel to tightly wrap the strip material around the mandrel and form the desired coil of strip material. The wrapper rolls can be controlled by using closed loop force regulation. Closed loop force regulation uses pressure transducers connected to each wrapper roll or connected to other structure connected to each wrapper roll such as, for example, hydraulic cylinders.

SUMMARY OF THE INVENTION

Roll gap control apparatuses of the invention have a first roll position detector for detecting a first position of a first roll, a second roll position detector for detecting a first position of a second roll and a third roll position detector for detecting a first position of a third roll. A processor determines a second position of the first roll based on the first position of the second roll and the first position of the third roll.

In some roll gap control apparatuses of the invention, the second position of the first roll is expressed as a first gap between the first roll and a first surface, the first position of the second roll is expressed as a second gap between the second roll and a second surface, the first position of the third roll is expressed as a third gap between the third roll and a third surface, and the first gap is determined by averaging the second gap and the third gap.

Strip mill coilers of the invention have a mandrel, a first roll for positioning a strip material around the mandrel, a second roll for positioning the strip material around the mandrel, and a third roll for positioning the strip material around the mandrel. A first roll position detector detects a first position of the first roll, a second roll position detector detects a first position of the second roll, a third roll position detector detects a first position of the third roll, and a processor determines a second position of the first roll based on the first position of the second roll and the first position of the third roll.

Methods of the invention detect a first position of a first roll, detect a first position of a second roll, detect a first position of a third roll, and determine a second position of the first roll based on the first position of the second roll and the first position of the third roll.

Computer programs of the invention have instructions for detecting a first position of a first roll, detecting a first position of a second roll, detecting a first position of a third roll, and determining a second position of the first roll based on the first position of the second roll and the first position of the third roll.

These and other features of the invention will be readily apparent to those skilled in the art upon reading this disclosure in connection with the attached drawing figures.

BRIEF DESCRIPTION OF THE DRAWINGS

FIGS. 5–10 are examples of controlled diagrams in accordance with systems and methods of the invention.

DETAILED DESCRIPTION OF EMBODIMENTS

Figure 1:
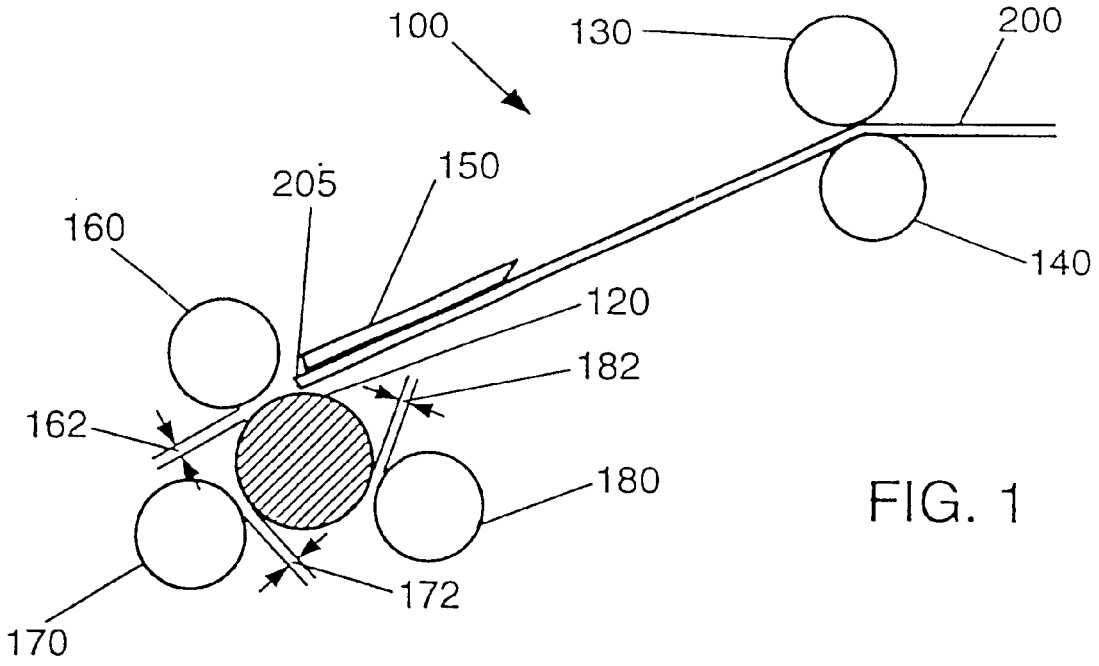
FIG. 1 is a partial view of a coiler in accordance with the invention.

The operation of controlling the wrapper rolls of a coiler of strip material in, for example, a hot strip mill can use closed loop force regulation. Closed loop force regulation utilizes pressure transducers connected to each wrapper roll. The pressure transducers can be attached to hydraulic cylinders that position each wrapper roll. The pressure transducers are subjected to very high impact forces when the coiler is being threaded and the environment in which coilers are located often contain moisture and high ambient temperatures. As a result, the pressure transducers often fail. When pressure transducers fail, control of the coiling process can be adversely affected, often resulting in a dangerous situation and/or an extremely expensive mill shutdown.

The invention enables the continued use of a coiler without the pressure transducers by operating the wrapper rolls in closed loop position control instead of pressure control. By enabling the continued operation of a strip mill when force feedback, and therefore pressure control, is not available, dangerous situations can be avoided while maintaining productivity of the strip mill. The invention accomplishes this by dynamically manipulating a gap reference for each wrapper roll based on the gap feedback of the other wrapper rolls. For example, the gap reference for each wrapper roll can be based on an average gap feedback of the other wrapper rolls. Also, if one of the pressure transducers used for determining the force feedback of a first wrapper roll fails, the invention can disable closed loop force regulation for the first wrapper roll and position the first wrapper roll using closed loop position control. In closed loop position control, the first wrapper roll's gap reference is dynamically calculated as a function of, for example the average, gap feedback of the other wrapper rolls. This operation results in a soft position regulation control scheme where the first wrapper roll is still fully involved in the coiling process without being subjected to excessive forces.

The invention also allows control of all wrapper rolls under a soft position regulation control scheme when no wrapper roll force feedback is available. In this case, each wrapper roll uses the gap feedback of the other wrapper rolls to determine its gap reference. As a result, when the strip is threaded around the mandrel and impacts any wrapper roll, that wrapper roll will be pushed out slightly from the mandrel, resulting in changes in the position references for the other wrapper rolls which cause those wrapper rolls to move away from the mandrel. This, in turn, prevents the wrapper roll which was originally moved by the strip from returning to its original position.

The softness of the position regulator can be controlled by manipulating the position references to include a positive or negative offset. If the offset is a positive value, then the operation will be softer (a looser coil) and if the offset is a negative value, the operation will provide tighter head end coiling.

FIG. 1 shows a partial view of a coiler 100 in accordance with the invention. In coiler 100, a strip 200 of material is fed through pinch rolls 130, 140 toward a mandrel 120. Strip 200 is directed between mandrel 120 and a first wrapper roll 160 by a strip guide 150. It is noted that many elements of coiler 100 have been omitted from the figures for clarity. For example, additional strip guiding devices can be utilized. First wrapper roll 160 along with additional wrapper rolls, represented here by a second roll 170 and a third wrapper roll 180, control the position of strip 200 so that it is coiled around mandrel 120. Although three wrapper rolls are shown in this example, any appropriate number of wrapper rolls can be used.

FIG. 1 shows the point in the coiling process immediately prior to a strip head 205 of strip 200 entering a gap 162 between first wrapper roll 160 and mandrel 120. Gap 162 is approximately equivalent to a thickness of strip 200. Second wrapper roll 170 and third wrapper roll 180 are similarly spaced away from mandrel 120 to form gaps 172, 182, respectively.

Figure 2:
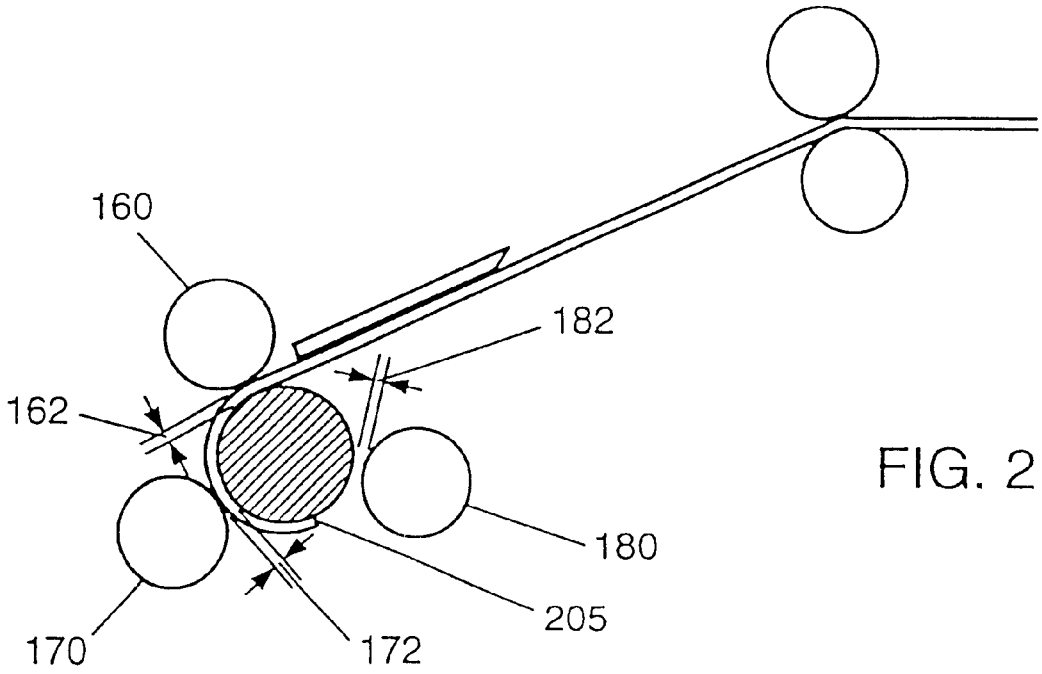
FIG. 2 is a partial view of the coiler of FIG. 1 after partial coiling.
Figure 3:
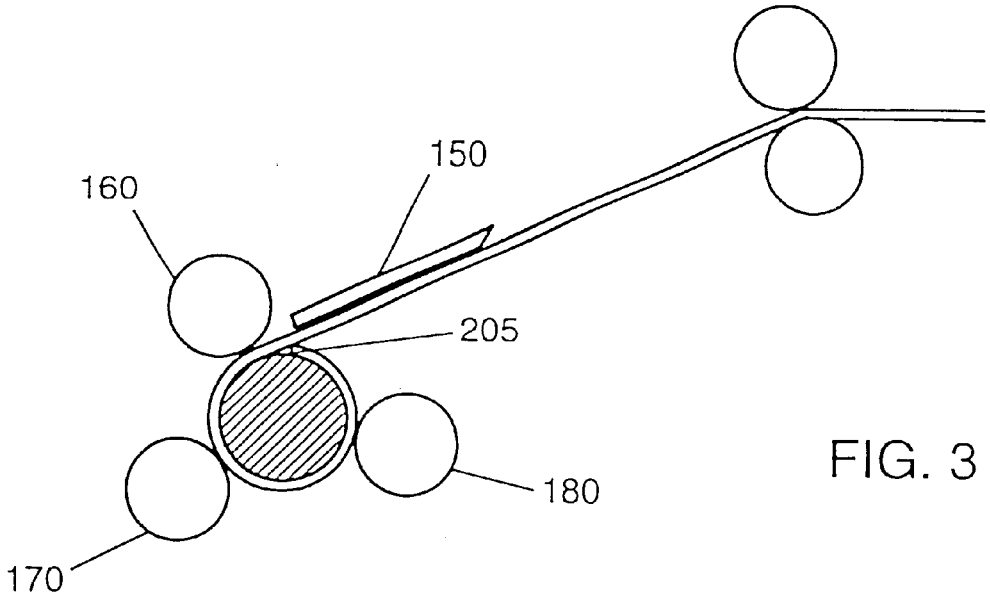
FIG. 3 is a partial view of the coiler of FIGS. 1 and 2 after completion of a first wrap.
Figure 4:
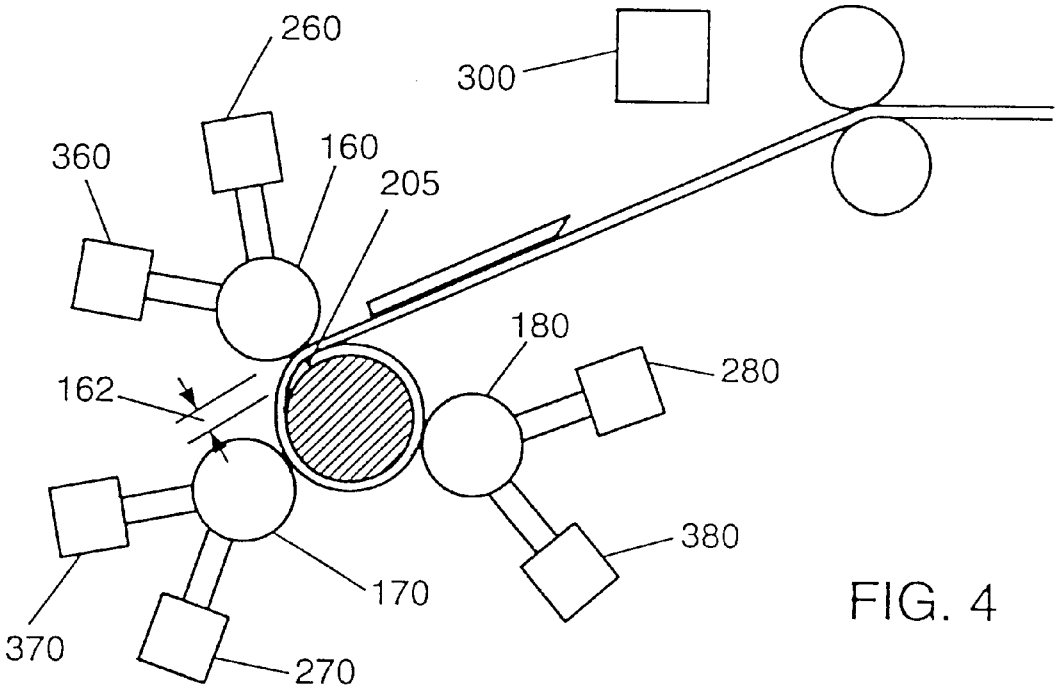
FIG. 4 is a partial view of the coiler of FIGS. 1–3.

As shown in FIG. 2, as coiling continues, strip head 205 proceeds around mandrel 120 through gap 172 and approaches gap 182. FIG. 3 shows the coiling process after strip head 205 has passed through gap 182 and approaches first wrapper roll 160. FIG. 4 shows strip head 205 in gap 162 as a first wrap around mandrel 120 is completed. At this position, first wrapper roll 160 is pushed radially outward away from mandrel 120 by strip 200 beginning formation of a second wrap. At this point, a first position detector 260 detects the position of first wrapper roll 160 and transmits this information to a processor 300. Similarly, a second position detector 270 detects the position of second wrapper roll 170 and transmits this information to the processor 300. Also, a third position detector 280 detects the position of third wrapper roll 180 and transmits this information to the processor 300. Any of the wrapper rolls that are not under closed loop force control can use closed loop position control where the gap reference is determined from the position detectors described above. For any of first wrapper roll 160, second wrapper roll 170 and third wrapper roll 180 that are under closed loop position control in accordance with the invention, the processor 300 will calculate a new position for that wrapper roll based on the positions of the other wrapper rolls as detected by first position detector 260, a second position detector 270 and a third position detector 280. For example, processor 300 can calculate a new position for second wrapper roll 170 by averaging the position of first wrapper roll 160 and third wrapper roll 180. Any position changes resulting from the above calculation are enacted by moving first wrapper roll 160, second wrapper roll 170 and/or third wrapper roll 180 by way of a first position regulator 360, a second position regulator 370 and/or a third position regulator 380, respectively.

If one or more of the wrapper rolls are controlled through force regulation, the position of that wrapper roll or rolls, is still used in calculating the new position of any wrapper roll controlled through position regulation.

Coiling of the strip continues in this manner until the wrapper rolls are retracted away from the coil.

FIGS. 5–10 show control diagrams of systems and methods of the invention using the first wrapper roll as an example. It is noted that similar logic can be used for all wrapper rolls.

FIG. 5 is an example of logic associated with determining the regulation mode, i.e., open loop control, closed loop position control, or closed loop force control. The logic block identified as block 20 is used to determine when to use open loop control. The logic block identified as block 30 is used to determine when to use closed loop position control. The logic block identified as block 40 is used to determine when to use closed loop force control. The output signals of these three blocks are mutually exclusive and determine which control software to run. In block 40, the two contacts E and F are used to disable force control under the conditions of either pressure transducer failing for this wrapper roll.

FIG. 6 represents the logic associated with open loop control of the wrapper roll. This logic will be executed whenever the signal generated by block 20 in FIG. 5 is true.

Figure 7:
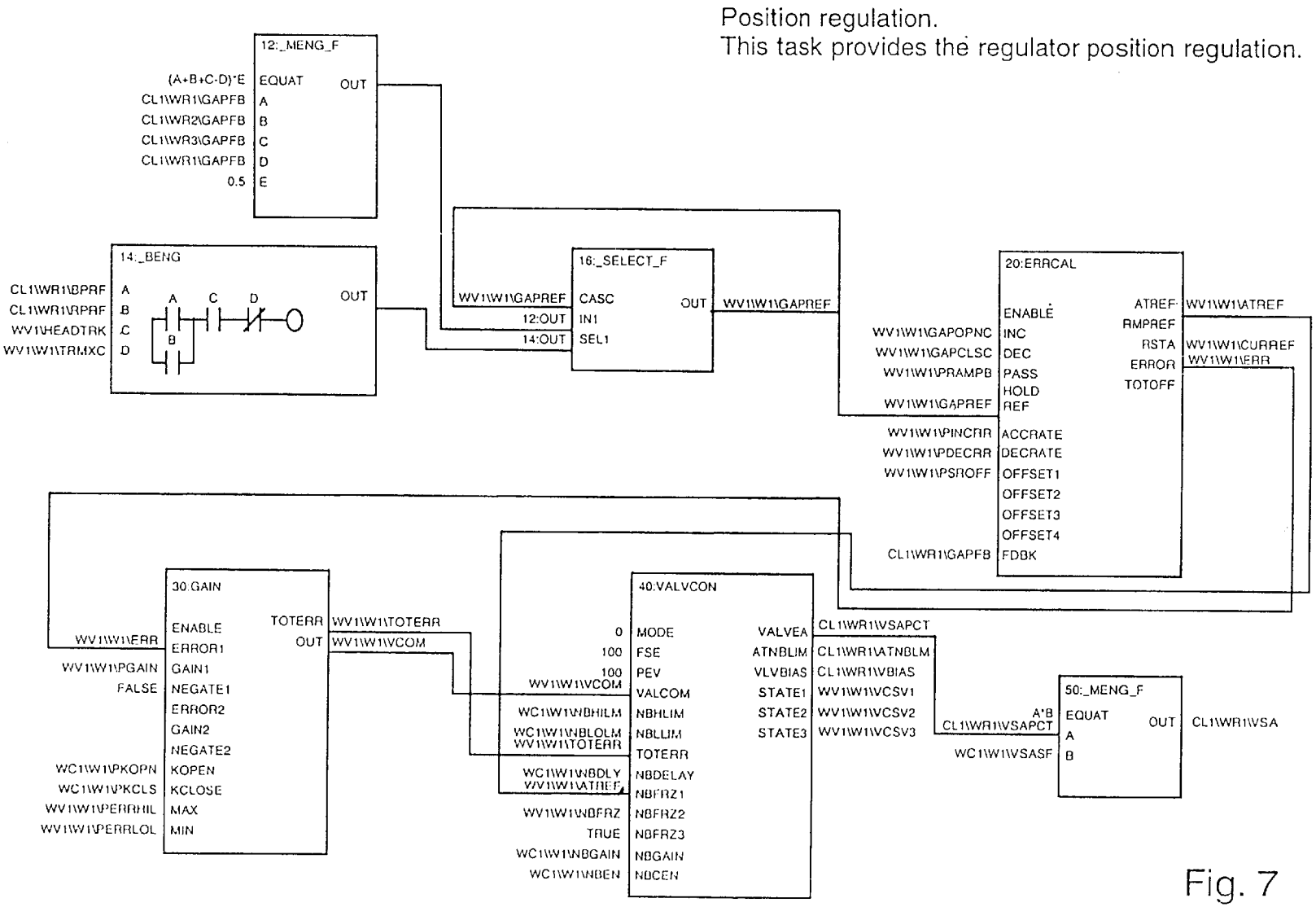

FIGS. 7 and 8 represent the logic associated with closed loop position control of the wrapper roll. This logic will be executed whenever the signal generated by block 30 in FIG. 5 is true. Blocks 12, 14 and 16 are used to override the position reference for the wrapper roll under conditions where force regulation has been disabled. Block 12 is used to calculate a new position reference dynamically, block 14 is used to determine when this reference should be applied and block 16 is used to apply this reference.

Figure 9:
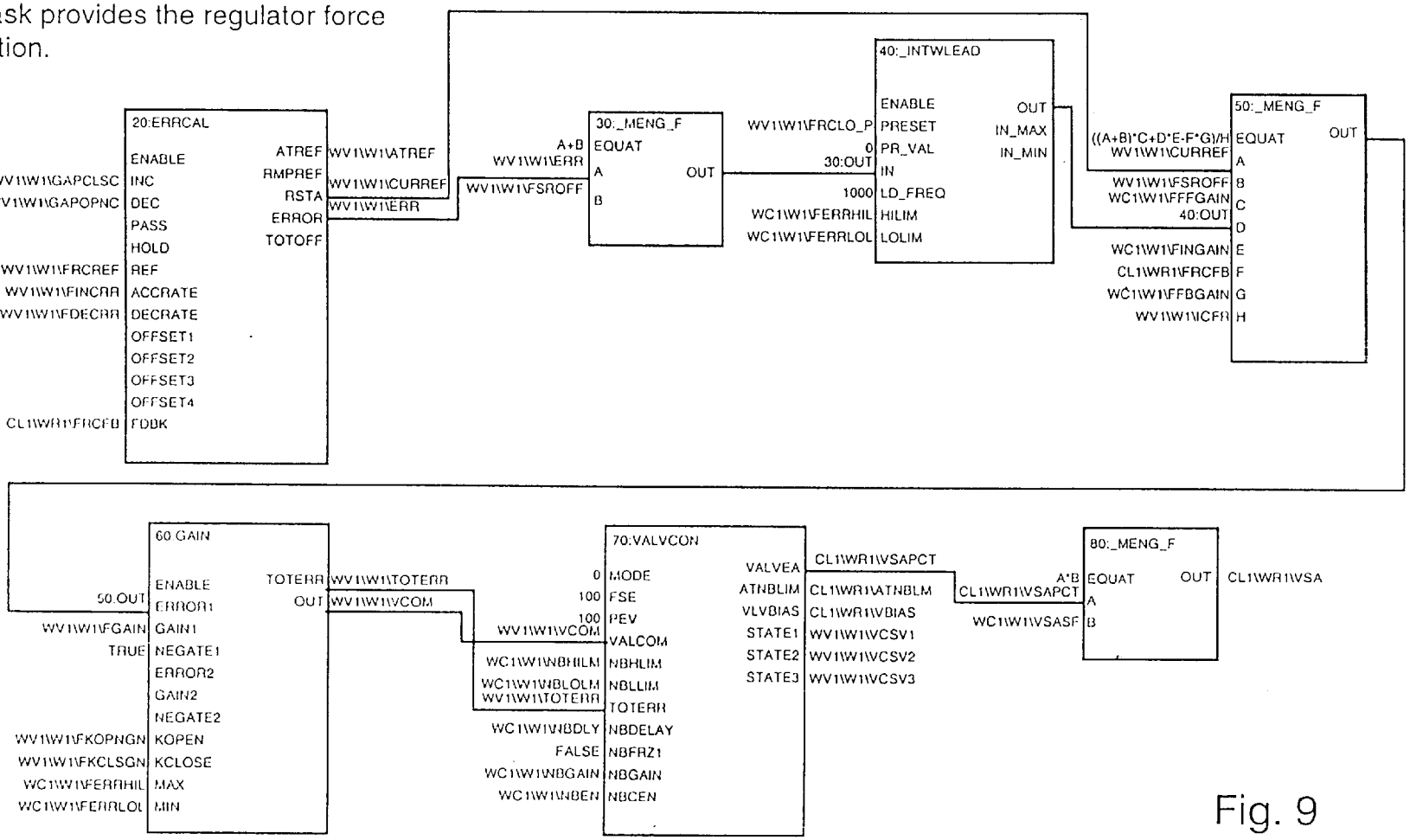

FIGS. 9 and 10 represent the logic associated with closed loop force control of the wrapper roll. This logic will be executed whenever the signal generated by block 40 in FIG. 5 is true.

It is noted that FIGS. 5–10 show examples of controls in accordance with systems and methods of the invention, and are in no way limiting. It is further noted that other controls in accordance with the spirit and scope of the invention are also appropriate.

While the invention has been described with reference to particular embodiments and examples, those skilled in the art that various modifications may be made thereto without significantly departing from the spirit and scope of the invention.

What is claimed is:

1. A roll gap control apparatus, comprising:

a first roll position detector for detecting a first position of a first roll;

a second roll position detector for detecting a first position of a second roll;

a third roll position detector for detecting a first position of a third roll; and a processor that determines a second position of the first roll, wherein the second position of the first roll is determined based on the first position of the second roll and the first position of the third roll.

2. The roll gap control apparatus of claim 1, wherein the second position of the first roll is expressed as a first gap between the first roll and a first surface;

the first position of the second roll is expressed as a second gap between the second roll and a second surface, the first position of the third roll is expressed as a third gap between the third roll and a third surface, and the first gap is determined based on the second gap and the third gap.

3. The roll gap control apparatus of claim 2, further comprising a first roll position regulator for moving the first roll to the second position of the first roll.

4. The roll gap control apparatus of claim 2, wherein the first surface is one of a mandrel and a strip material coiled around the mandrel, the second surface is one of the mandrel and the strip material coiled around the mandrel, and the third surface is one of the mandrel and the strip material coiled around the mandrel.

5. The roll gap control apparatus of claim 4, wherein the processor determines a second position of the second roll, and the second position of the second roll is determined based on the first gap and the third gap.

6. The roll gap control apparatus of claim 5, wherein the processor determines a second position of the third roll, and the second position of the third roll is determined based on the first gap and the second gap.

7. The roll gap control apparatus of claim 6, wherein the processor continuously recalculates the first, second and third gaps.

8. A strip mill coiler, comprising:

a mandrel;

a first roll for positioning a strip material around the mandrel;

a second roll for positioning the strip material around the mandrel;

a third roll for positioning the strip material around the mandrel;

a first roll position detector for detecting a first position of the first roll;

a second roll position detector for detecting a first position of the second roll;

a third roll position detector for detecting a first position of the third roll; and a processor that determines a second position of the first roll, wherein the second position of the first roll is determined based on the first position of the second roll and the first position of the third roll.

9. The strip mill coiler of claim 8, wherein the second position of the first roll is expressed as a first gap between the first roll and a first surface;

the first position of the second roll is expressed as a second gap between the second roll and a second surface, the first position of the third roll is expressed as a third gap between the third roll and a third surface, the first gap is determined based on the second gap and the third gap, the first surface is one of the mandrel and the strip material coiled around the mandrel, the second surface is one of the mandrel and the strip material coiled around the mandrel, and the third surface is one of the mandrel and the strip material coiled around the mandrel.

10. The strip mill coiler of claim 9, further comprising a first roll position regulator for moving the first roll to the second position of the first roll.

11. The strip mill coiler of claim 9, wherein the processor determines a second position of the second roll, and the second position of the second roll is determined based on the first gap and the third gap.

12. The strip mill coiler of claim 11, wherein the processor determines a second position of the third roll, and the second position of the third roll is determined based on the first gap and the second gap.

13. The strip mill coiler of claim 12, wherein the processor continuously recalculates the first, second and third gaps.

14. A method of controlling roll gap, comprising:

detecting a first position of a first roll;

detecting a first position of a second roll;

detecting a first position of a third roll; and determining a second position of the first roll, wherein the second position of the first roll is determined based on the first position of the second roll and the first position of the third roll.

15. The method of claim 14, wherein the second position of the first roll is expressed as a first gap between the first roll and a first surface;

the first position of the second roll is expressed as a second gap between the second roll and a second surface, the first position of the third roll is expressed as a third gap between the third roll and a third surface, and the first gap is determined based on the second gap and the third gap.

16. The method of claim 15, further comprising moving the first roll to the second position of the first roll.

17. The method of claim 15, wherein the first surface is one of a mandrel and a strip material coiled around the mandrel, the second surface is one of the mandrel and the strip material coiled around the mandrel, and the third surface is one of the mandrel and the strip material coiled around the mandrel.

18. The method of claim 17, further comprising determining a second position of the second roll, and the second position of the second roll is determined based on the first gap and the third gap.

19. The method of claim 18, further comprising determining a second position of the third roll, and the second position of the third roll is determined based on the first gap and the second gap.

20. The method of claim 19, wherein the first, second and third gaps are continuously recalculated.

21. The method of claim 14, wherein the second position of the first roll is determined by averaging the first position of the second roll and the first position of the third roll.

22. A computer program for controlling roll gap, the program comprising instructions for detecting a first position of a first roll;

detecting a first position of a second roll;

detecting a first position of a third roll; and determining a second position of the first roll, wherein the second position of the first roll is determined based on the first position of the second roll and the first position of the third roll.

23. The program of claim 22, wherein the second position of the first roll is expressed as a first gap between the first roll and a first surface;

the first position of the second roll is expressed as a second gap between the second roll and a second surface, the first position of the third roll is expressed as a third gap between the third roll and a third surface, and the first gap is determined based on the second gap and the third gap.

24. The program of claim 23, further comprising instructions for moving the first roll to the second position of the first roll.

25. The program of claim 23, wherein the first surface is one of a mandrel and a strip material coiled around the mandrel, the second surface is one of the mandrel and the strip material coiled around the mandrel, and the third surface is one of the mandrel and the strip material coiled around the mandrel.

26. The program of claim 25, further comprising instructions for determining a second position of the second roll, and the second position of the second roll is determined based on the first gap and the third gap.

27. The program of claim 26, further comprising instructions for determining a second position of the third roll, and the second position of the third roll is determined based on the first gap and the second gap.

28. The program of claim 27, further comprising instructions for continuously recalculating the first, second and third gaps.

29. The program of claim 22, wherein the second position of the first roll is determined by averaging the first position of the second roll and the first position of the third roll.

* * * * *